US006732713B1

(12) United States Patent
Kanazawa et al.

(10) Patent No.: US 6,732,713 B1
(45) Date of Patent: May 11, 2004

(54) CRANK ANGLE DETECTION APPARATUS

(75) Inventors: Eiji Kanazawa, Tokyo (JP); Shiro Yonezawa, Tokyo (JP); Tomokazu Makino, Tokyo (JP); Takuo Watanuki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/417,192

(22) Filed: Apr. 17, 2003

(30) Foreign Application Priority Data

Nov. 13, 2002 (JP) ..... 2002-329359

(51) Int. Cl.[7] ..... F02M 51/00
(52) U.S. Cl. ..... 123/476; 123/631; 123/406.6
(58) Field of Search ..... 123/476, 631, 123/406.6, 406.58, 406.56

(56) References Cited

U.S. PATENT DOCUMENTS 5,979,413 A * 11/1999 Ohnuma et al. ..... 123/491
6,172,500 B1 * 1/2001 Bicking ..... 324/207.22
6,341,253 B1 * 1/2002 Honda ..... 701/102

FOREIGN PATENT DOCUMENTS

JP 62-178734 A 8/1987
JP 62-182463 A 8/1987
JP 11-062687 A 3/1999
JP 11-117780 A 4/1999

* cited by examiner

*Primary Examiner*—Bibhu Mohanty
(74) *Attorney, Agent, or Firm*—Sughrue Mion, PLLC

(57) ABSTRACT

Even if the engine is started from any crank angle position, it is possible to correctly determine the rotational direction of a crankshaft, so that fuel injection or ignition can be stopped when the crankshaft is rotating in the reverse direction. A measurement member has a plurality of angular position detection portions arranged at equal intervals in a circumferential direction of the crankshaft and a plurality of reference position detection portions at which a part of the angular position detection portions is missing. A crank angle sensor is arranged near the measurement member for generating a crank angle signal representative of the rotational position of the crankshaft. A period detector detects periods of pulses of the crank angle signal. A reference position determiner determines a plurality of reference positions based on the signal periods. A counter counts the pulses of the crank angle signal. A rotational direction determiner detects the rotational direction of the crankshaft from the number of pulses counted between a plurality of reference positions.

9 Claims, 14 Drawing Sheets

CRANK ANGLE DETECTION APPARATUS

BACKGROUND OF THE INVENTION

1. Field of the Invention

The present invention relates to a crank angle detection apparatus for detecting the crank angle of the crankshaft of an internal combustion engine, and more particularly, it relates to such a crank angle detection apparatus capable of identifying the rotational direction of the crankshaft.

2. Description of the Related Art

Conventionally, an apparatus for identifying the rotational direction of the crankshaft of an internal combustion engine has been proposed which includes: a first signal generating part and a second signal generating part that generate pulse signals in accordance with the rotational speeds or numbers of revolutions per minute of rotating elements, respectively, which are formed on their outer peripheries with a plurality of teeth arranged at equal intervals in their circumferential direction in such a manner that the signals generated by these signal generating parts become different from each other; a deviation part for obtaining a deviation between the signals generated by the first and second signal generating parts; and a first processing part for processing the deviation between the signals into a signal by means of a filter; wherein the signal thus processed is compared with a determination value to provide a processed pulse signal, from the period of generation of which it is determined whether the internal combustion engine is rotating in the forward direction or in the reverse direction (for instance, see document 1: Japanese patent application laid-open No. Hei 11-117780 (FIG. 1 and FIG. 2)).

Also, another rotational direction identification apparatus has been proposed which includes a first sensor for generating a crank angle signal at each prescribed angle of rotation of the crankshaft of an internal combustion engine, and a second sensor for generating one reference signal during the time the crankshaft makes two revolutions, the first and second sensors being arranged in such a manner that a phase difference between a pulse of the crank angle signal, which is generated immediately before the generation of a pulse of the reference signal, and that pulse of the reference signal, and a phase reference between a pulse of the crank angle signal, which is generated immediately after the generation of that pulse of the reference signal, and that pulse of the reference signal are made different from each other, so as to determine or identify the rotational direction of the crankshaft based on the magnitude correlation of these phase differences (for instance, see document 2: Japanese patent application laid-open No. Hei 11-62687 (from paragraph No. 0016 to paragraph No. 0017 and FIG. 2)).

In addition, a further rotational direction identification apparatus has been proposed which includes a reference signal generating part for generating a reference signal at a reference position of an engine crankshaft in synchronization with the rotation of an internal combustion engine, an angle signal generating part for generating a plurality of angle signals or signal pulses more than a predetermined number during one cycle or period of the reference signal in synchronization with the rotation of the internal combustion engine, and an angle signal counting part which is repeatedly reset in synchronization with the reference signal for counting signal pulses of the angle signal, wherein if the count value of the angle signal counting part during a generation period of the reference signal is not equal to a predetermined value, it is determined that the internal combustion engine is rotating in the reverse direction, thus interrupting or cutting at least one of the ignition and the fuel injection (for instance, see document 3: Japanese patent application laid-open No. Sho 62-182463 (second page and FIG. 2)).

The conventional rotational direction or reverse rotation detection apparatuses as described above is able to determine whether the engine is rotating in the reverse direction, but involves the following problems. That is, it is impossible to generate the reference crank angle signal for accurately controlling the fuel injection, the ignition timing, etc., in accordance with the operating conditions of an internal combustion engine, and hence it is necessary to separately provide a crank angle detection sensor for generating a reference crank angle signal.

Moreover, it is necessary to provide a reference position detection device which is mounted on a camshaft for obtaining a reference signal, in addition to one mounted on the crankshaft.

Further, it is also possible to mount two sensors on the crankshaft separately from each other for obtaining two crank angle signals at the same time, but in this case, it is necessary to install two measurement members on the crankshaft.

Furthermore, when the angle signal begins to be counted from the point or location at which the crank angle position is a half of the reference signal generation period, the count value of the angle signal counting part during the forward rotation becomes equal to that during the reverse rotation, and hence it is impossible to detect the rotational direction or reverse rotation of the engine.

SUMMARY OF THE INVENTION

Accordingly, one object of the present invention is to provide a crank angle detection apparatus which is capable of supplying a crank angle signal as well as identifying the rotational direction of the crankshaft of an internal combustion engine.

Another object of the present invention is to provide a crank angle detection apparatus which is capable of identifying the reverse rotation of an internal combustion engine in a reliable manner even if the engine is started from any crank angle position.

Bearing the above object in mind, according to the present invention, there is provided a crank angle detection apparatus which is constructed as follows. A measurement member is mounted on a crankshaft of an internal combustion engine or a portion that rotates in synchronization with the crankshaft, the measurement member having a plurality of angular position detection portions arranged at equal intervals in a circumferential direction of the crankshaft and a plurality of reference position detection portions at which a part of the angular position detection portions is missing. A crank angle sensor is arranged at a location adjacent to the measurement member for generating a crank angle signal in the form of a train of pulses corresponding to the angular position detection portions and the reference position detection portions. A period detection part detects signal periods of successive pulses of the crank angle signal. A reference position determination part determines a plurality of reference positions based on the signal periods detected by the period detection part. A counting part counts the pulses of the crank angle signal to provide a count value thereof. A rotational direction determination part determines the rotational direction of the crankshaft based on the number of pulses of the crank angle signal counted between the plurality of reference positions.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Now, preferred embodiments of the present invention will be described below in detail while referring to the accompanying drawings.

EMBODIMENT 1

Figure 1:
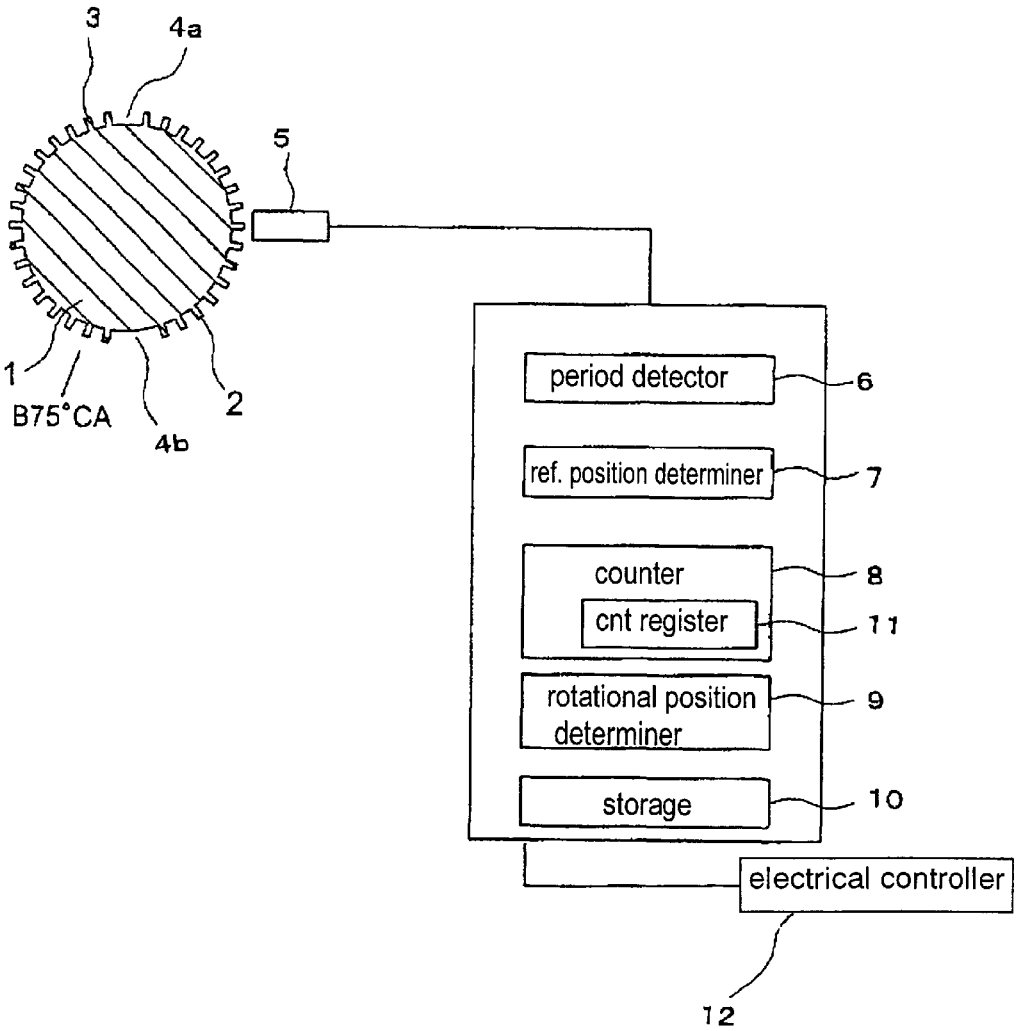
FIG. 1 is a constructional view of a crank angle detection apparatus according to a first embodiment of the present invention.
Figure 2:
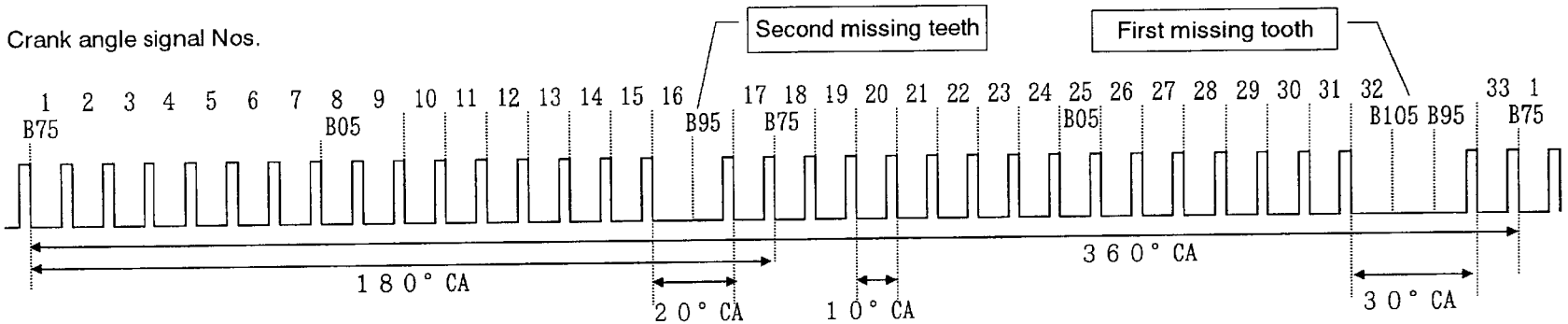
FIG. 2 shows a crank angle signal generated by a crank angle sensor of FIG. 1.
Figure 3:
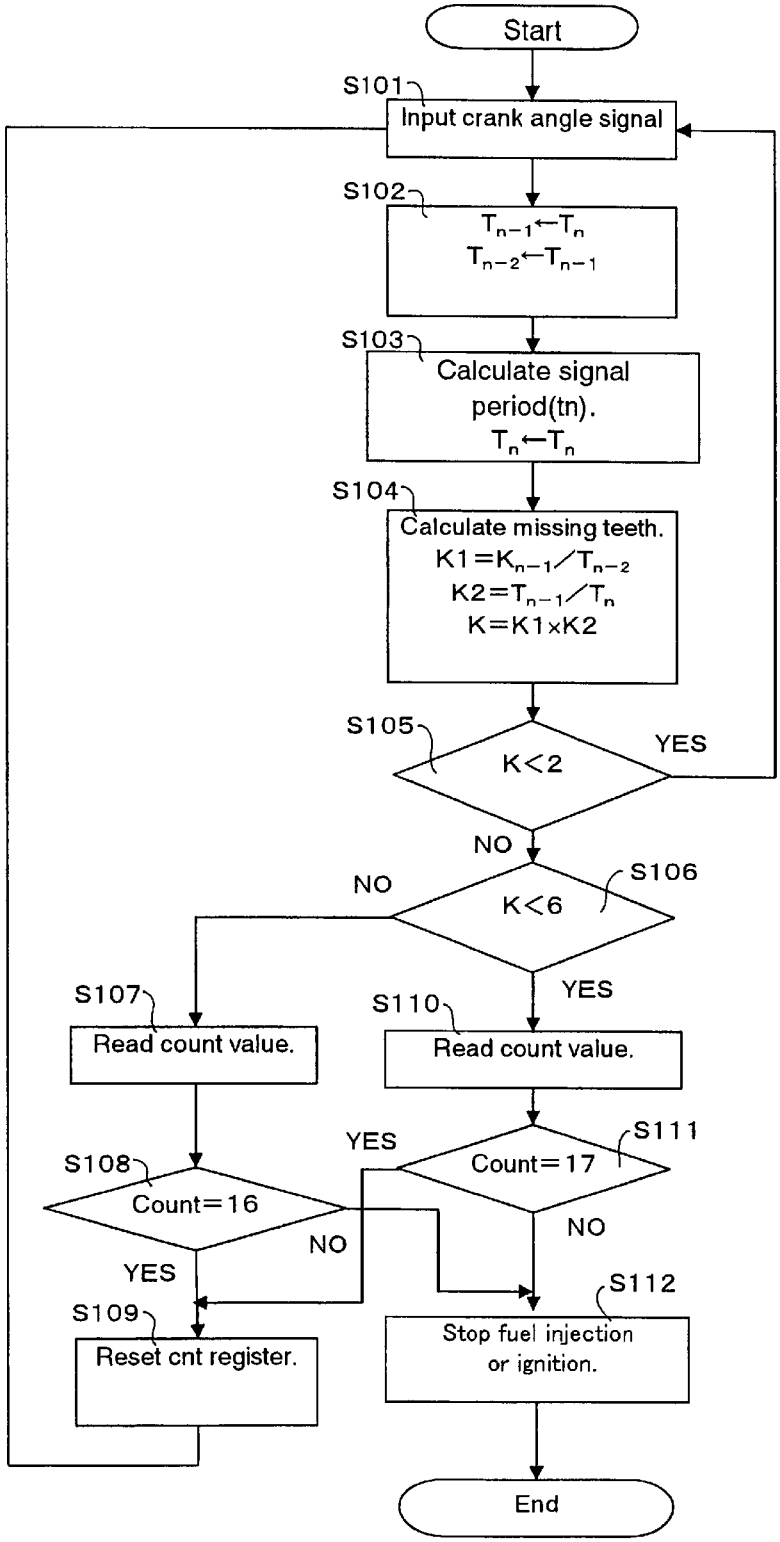
FIG. 3 is a flow chart showing the operation of the crank angle detection apparatus of FIG. 1.
Figure 4:
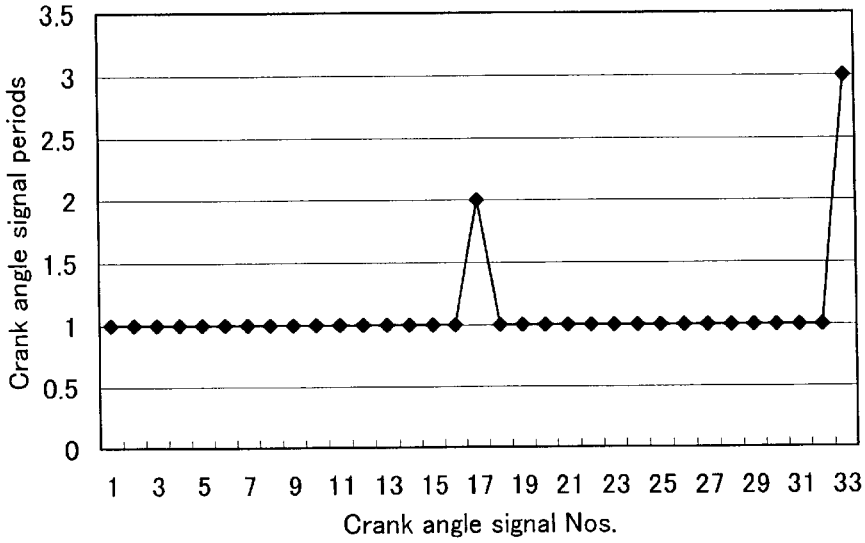
FIG. 4 shows the data of crank angle signal periods of FIG. 1.
Figure 5:
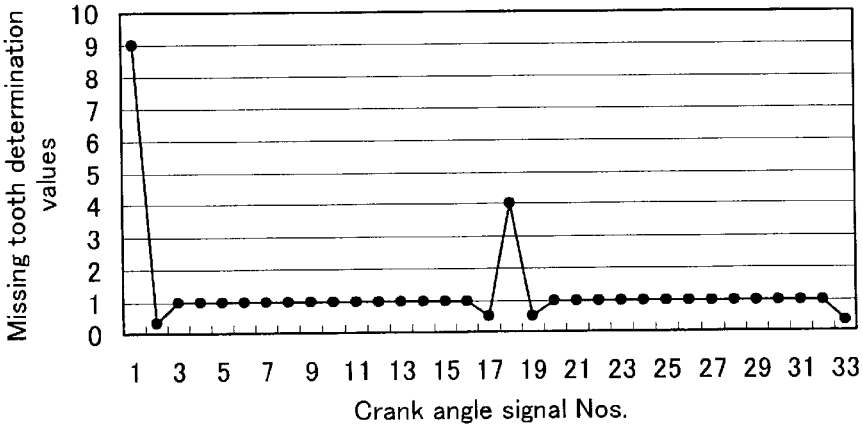
FIG. 5 shows missing tooth determination values according to the crank angle detection apparatus of FIG. 1.
Figure 6:
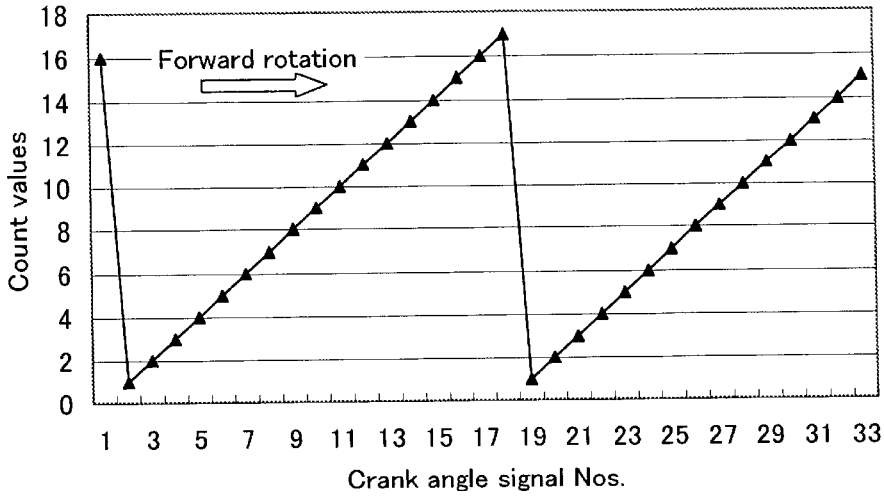
FIG. 6 shows count values of pulses of a crank angle signal according to the crank angle detection apparatus of FIG. 1.
Figure 7:
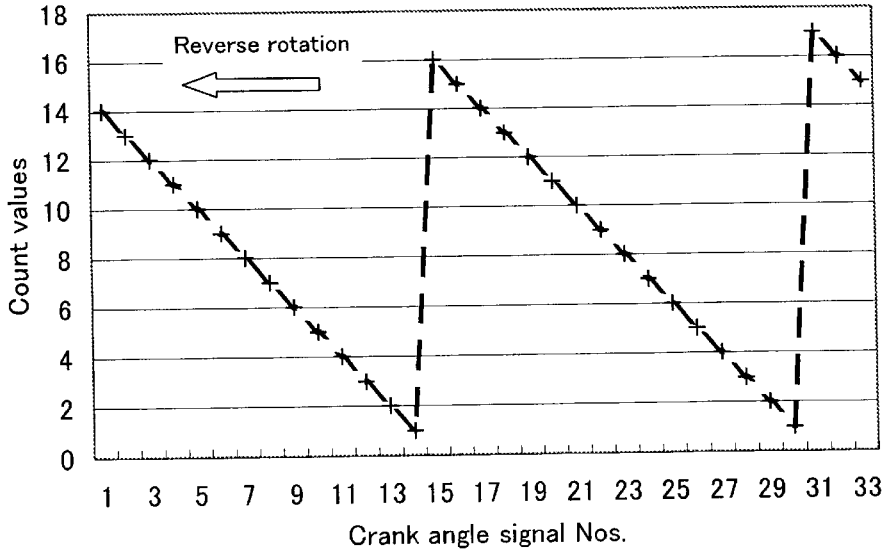
FIG. 7 shows count values of pulses of a crank angle signal and missing tooth determination values when the crankshaft is rotating in the reverse direction.

FIG. 1 shows the configuration of a crank angle detection apparatus for an internal combustion engine according to a first embodiment of the present invention. FIG. 2 is a pattern chart of a crank angle signal generated by a crank angle sensor when the crankshaft of an internal combustion engine is caused to rotate. FIG. 3 is a flow chart for identifying the rotational direction of the crankshaft according to the crank angle detection apparatus of the first embodiment. FIG. 4 shows periods of the crank angle signal at respective calculation timing. FIG. 5 shows missing tooth determination values K at respective calculation timings. FIG. 6 and FIG. 7 show the count values at respective calculation timings when the crankshaft is rotating in the forward direction and when the crankshaft is rotating in the reverse direction, respectively. FIG. 7 indicates that the crank angle signal numbers are decreasing while the engine is rotating in the reverse direction. For instance, counting of crank angle signal pulses is started to add or increment from crank angle signal No. 30 up to crank angle signal No. 15 to indicate the number of counted pulses of 16, where it is reset. In addition, counting or addition is started from crank angle signal No. 14 up to crank angle signal No. 31 to indicate the number of counted pulses of 17.

The crank angle detection apparatus includes: a member 2 to be measured (hereinafter referred to as a measurement member) formed on the circumference of a crankshaft 1 of an internal combustion engine and having a multitude of angular position detection portions 3 and a plurality of reference position detection portions 4*a*, 4*b*; a crank angle sensor 5 arranged in opposition to the measurement member 2 for generating a signal in the form of a train of pulses corresponding to changes in the magnetic flux caused by the angular position detection portions 3 and the reference position detection portions 4*a*, 4*b* of the measurement member 2 in accordance with the rotation thereof; a period detector or period detection part 6 for determining the periods of successive pulses of the crank angle signal (i.e., signal period) from the output of the crank angle sensor 5; a ref. position determiner or reference position determination part 7 for detecting two kinds of first and second reference positions 4*a*, 4*b* from the periods of the crank angle signal; a counter or counting part 8 for counting the number of pulses of the crank angle signal; and a rotational direction determiner or rotational direction determination part 9 for determining, based on the number of pulses of the crank angle signal counted between the two kinds of reference positions 4*a*, 4*b*, whether the crankshaft 1 is rotating in the forward direction or in the reverse direction.

The angular position detection portions 3 of the measurement member 2 are in the form of teeth and are arranged on the outer periphery of the crankshaft 1 at equal intervals of 10 degrees. The measurement member 2 has the first reference position detection portion 4*a* at which one angular position detecting portion 3 is missing at a crank angle of 95 degrees before top dead center (hereinafter referred to as B95° CA) in a one half (i.e., 180° CA) of one revolution and which extends over an angular range of 20° CA, and a second reference position detection portion 4*b* at which two angular position detection portions 3 are missing at crank angles of 95 degrees and 105 degrees before top dead center (i.e., B95° CA and B105° CA) in another half (i.e., 180° CA) of one revolution and which extends over an angular range of 30 degrees (i.e., 30° CA). Note that the position of B75° CA is set as a reference crank angle.

The crank angle sensor 5 comprises a magnetoresistive sensor that generates signal pulses corresponding to changes in the magnetic flux caused by the angular position detection portions 3 and the reference position detection portions 4*a*, 4*b* in accordance with the rotation of the measurement member 2.

The period detection part 6 measures the time between a falling edge of each crank angle signal pulse input thereto from the crank angle sensor 5 and a falling edge of the last or immediately preceding crank angle signal pulse previously obtained, and stores it in a storage or storage part 10 as a signal period $T_n$ (seconds).

The reference position determination part 7 obtains a reference position and the kind thereof by using ratios of each two of three signal periods whenever the signal period $T_n$ is obtained by the period detection part 6. When the crank angle sensor 5 passes the reference position detection portions 4*a*, 4*b*, there are obtained specific signal periods different from the signal period acquired when the crank angle sensor 5 passes the angular position detection portions 3. In FIG. 1, by calculating ratios between the specific signal periods obtained when the crank angle sensor 5 passes the reference position detection portions 4*a*, 4*b* and signal periods obtained before and after the specific signal periods, the value obtained by multiplying these ratios with each other indicates a value more emphasized than either one of these ratios. In FIG. 1, there are obtained successive ratios sequentially obtained from the current signal period $T_n$, the last signal period $T_{n-1}$ read out from the storage part 10, and the second last signal period $T_{n-2}$ also read out from the storage part 10. That is, a fist ratio K1 and a second ratio K2 are calculated as follows: $K1=T_{n-1}/T_{n-2}$ and $K2=T_{n-1}/T_n$. Then, a missing tooth determination value K is obtained by using the following missing tooth determination expression; $K=K1\times K2$.

When the missing tooth determination value K is less than 2, it is determined that there is no missing tooth. When the missing tooth determination value K is equal to or more than 2 but less than 6, it is determined that the number of missing teeth is one. In addition, when the missing tooth determination value K is equal to or more than 6, it is determined that the number of missing teeth is two. The position at which two missing teeth have been detected is made the first reference position 4*b*, and the position at which one missing tooth has been detected is made the second reference position 4*a*, and these pieces of information are sent to the counting part 8 and the rotational direction determination part 9.

The crank angle signal is input from the crank angle sensor 5 to the counting part 8, whereby the counting part 8 is triggered by the falling of a pulse of the crank angle signal to count the number of occurrences or pulses of the crank angle signal. When information on the reference positions sent from the reference position determination part 7 is input to the counting part 8, a counting (cnt) register 11 provided in the counting part 8 is reset.

When the reference position information is input from the reference position determination part 7 to the rotational direction determination part 9, the rotational direction determination part 9 takes in the count value of the counting register 11 of the counting part 8, and determines, based on the count value, whether the crankshaft 1 is rotating in the forward direction or in the reverse direction. The rotational direction of the crankshaft 1 thus obtained is sent from the rotational direction determination part 9 to an electronic controller 12 of the internal combustion engine.

Here, note that the period detection part 6, the reference position determination part 7, the counting part 8 and the rotational direction determination part 9 are constituted by a microcomputer. The operations of the storage part 10 and the counting register 11 are processed or performed by the microcomputer while using a DRAM and/or registers incorporated in the microcomputer.

The crank angle numbers described above the successive pulses of the crank angle signal in FIG. 2 are represented in consecutive order with a reference crank angle B75° CA being made as "1". The crank angle signal comprises a train of signal pulses at every crank angle of 10° CA within an angular range of 360° CA, and has no pulse at a location corresponding to a first missing tooth at a crank angle of 95 degrees before top dead center (i.e., B95° CA) and at locations corresponding to second missing teeth at angles of 95 degrees and 105 degrees before top dead center (i.e., B95° CA and B105° CA). Here, it is assumed that the periods of the crank angle signal to be detected or durations between successive pulses to be detected are in proportion to angular distances between successive angular position detection portions or teeth 3 on the outer periphery of the crankshaft 1.

Next, reference will be made to the operation of the crank angle detection apparatus.

In FIG. 3, when an unillustrated starting switch of the internal combustion engine is turned on, a crank angle signal is input from the crank angle sensor 5 to the main body of the crank angle detection apparatus in step S101. In step S102, the last acquired signal period $T_n$ and the second last acquired signal period $T_{n-1}$ are moved to prescribed areas for $T_{n-1}$ and $T_{n-2}$ in the storage part 10. In step S103, a time duration between the falling of the current input pulse of the crank angle signal and the falling of the last acquired pulse of the crank angle signal is measured and stored in the storage part 10 as a signal period $T_n$ (seconds) of the crank angle signal.

In step S103, the counting register 11 of the counting part 8 is incremented by 1 upon falling of the current input pulse of the crank angle signal. In step S104, the values of the current signal period $T_n$, the last acquired signal period $T_{n-1}$ and the second last acquired signal period $T_{n-2}$ of the crank angle signal are read out from the storage part 10. By substituting these values of the signal periods $T_n$, $T_{n-1}$ and $T_{n-2}$ into a missing tooth determination expression ($K=(T_{n-1})^2/(T_{n-2}\times T_{n-2})$), a missing tooth determination value K is obtained. In step S105, it is determined whether the missing tooth determination value K is less than 2. When the missing tooth determination value K is less than 2, the number of missing teeth is determined to be zero, and then the control flow returns to step S101. On the other hand, when the missing tooth determination value K is equal to or greater than 2, the control flow advances to step S106. In step S106, it is determined whether the missing tooth determination value K is less than 6. When the missing tooth determination value K is equal to or greater than 6, the control flow advances to step S107, whereas when the missing tooth determination value K is less than 6, the control flow advances to step S110. In step S107, a count value is read out from the counting register 11 of the counting part 8. In step S108, it is determined whether the count value thus read is equal to 16, and when the count value is equal to 16, the control flow advances to step S109. Here, the counting register 11 is reset and then the control flow returns to step S101. When the count value is other than 16 or not equal to 16, the control flow advances to step S112. In step S110, a count value is read out from the counting register 11 of the counting part 8. In step S111, it is determined whether the count value thus read is equal to 17, and when the count value is equal to 17, the control flow advances to step S109. When the count value is other than 17 or not equal to 17, the control flow advances to step S112 where a signal for stopping the fuel injection or ignition of the internal combustion engine is sent to the electronic controller 12, and the operation of the crank angle detection apparatus is ended.

In this manner, when the crank angle detection apparatus is driven to operate, the crank angle sensor 5 generates a crank angle signal, as shown in FIG. 2, so that signal periods shown in FIG. 4 is obtained to provide missing tooth determination values K, as shown in FIG. 5. The signal periods $T_{n-2}$, $T_{n-1}$ and $T_n$ at crank angle signal Nos. 3 to 16 and 20 to 32 are all equal to 1 from the missing tooth determination values K. Accordingly, since K becomes equal to 1, it is determined that there is no missing tooth. Also, at crank angle signal Nos. 17 and 19, K becomes equal to 0.5, and hence it is similarly determined that there is no missing tooth. Subsequently, at crank angle signal No. 18, K becomes equal to 4, so it is determined that there is one missing tooth. In addition, at crank angle signal No. 1, K becomes equal to 9, so it is determined that there are two missing teeth. Then, it is determined that the location corresponding to crank angle signal No. 1 is the first reference position, and that the location corresponding to crank angle signal No. 18 is the second reference position, as shown in FIG. 5.

FIG. 6 shows the changing or transition of the count value of pulses of the crank angle signal counted by the counting part 8. When the crankshaft 1 is rotating in the forward direction, a count value from the first reference position to the second reference position indicates 17, and the count value from the second reference position to the first reference position indicates 16. In addition, from the changing or transition of the count value as shown in FIG. 7 when the crankshaft 1 is rotating in the reverse direction, the count value from the first reference position to the second reference position indicates 16, and the count value from the second reference position to the first reference position indicates 17, so that the rotational direction of the crankshaft 1 can be identified by determining the kind and the count value of reference positions.

By using a sensor comprising the crank angle sensor 5 and the measurement member 2, the crank angle detection apparatus of this embodiment can generate a crank angle signal and at the same time determine the rotational direction of the crankshaft 1.

Moreover, even if the crankshaft 1 is started to rotate from any crank angle position, it is possible to obtain the rotational direction of the crankshaft 1.

Further, it is not necessary to provide any special sensor for detecting the reference positions separately from the crank angle sensor 5.

Furthermore, when it is determined that the crankshaft 1 is rotating in the reverse direction, it is possible to suppress damage to the internal combustion engine by stopping the fuel injection or ignition of the internal combustion engine.

Besides, one missing tooth or two missing teeth are employed as the missing tooth intervals or distances, but the numbers of missing teeth are not limited to these values and any numbers may be employed as long as they are different from each other.

Embodiment 2

Figure 8:
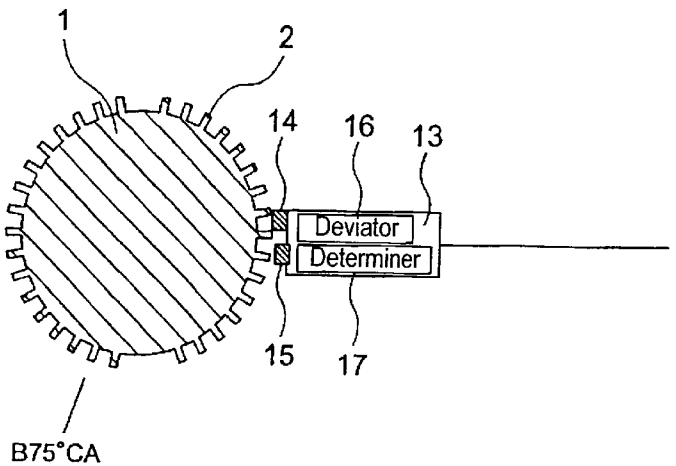
FIG. 8 is a schematic view of a crank angle sensor according to a second embodiment of the present invention.
Figure 9:
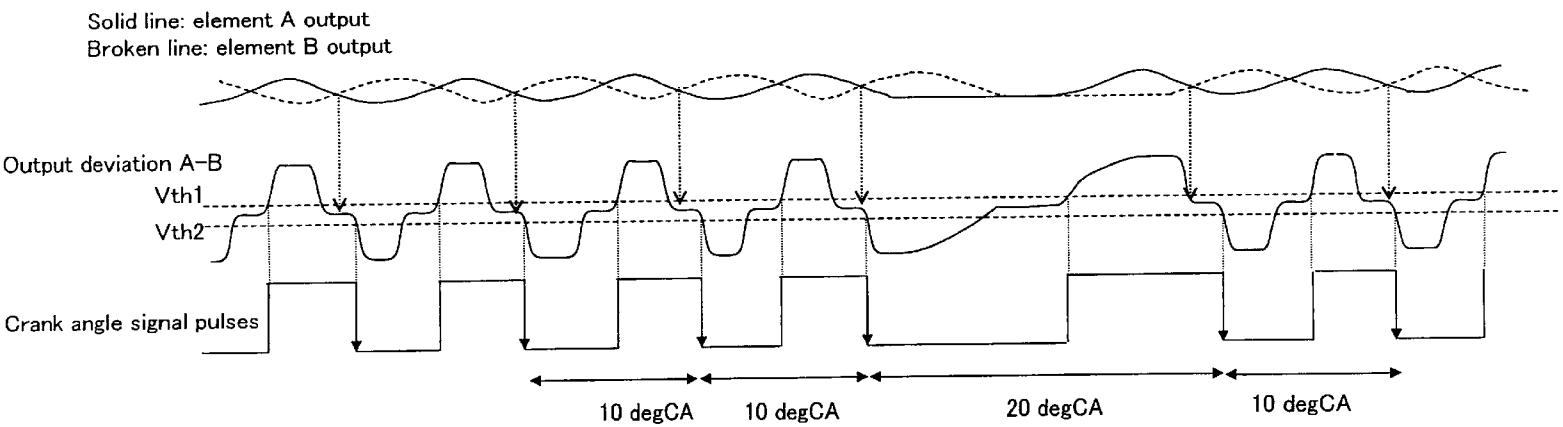
FIG. 9 shows a crank angle signal generated by the crank angle sensor of FIG. 8 when the crankshaft is rotating in the forward direction.
Figure 10:
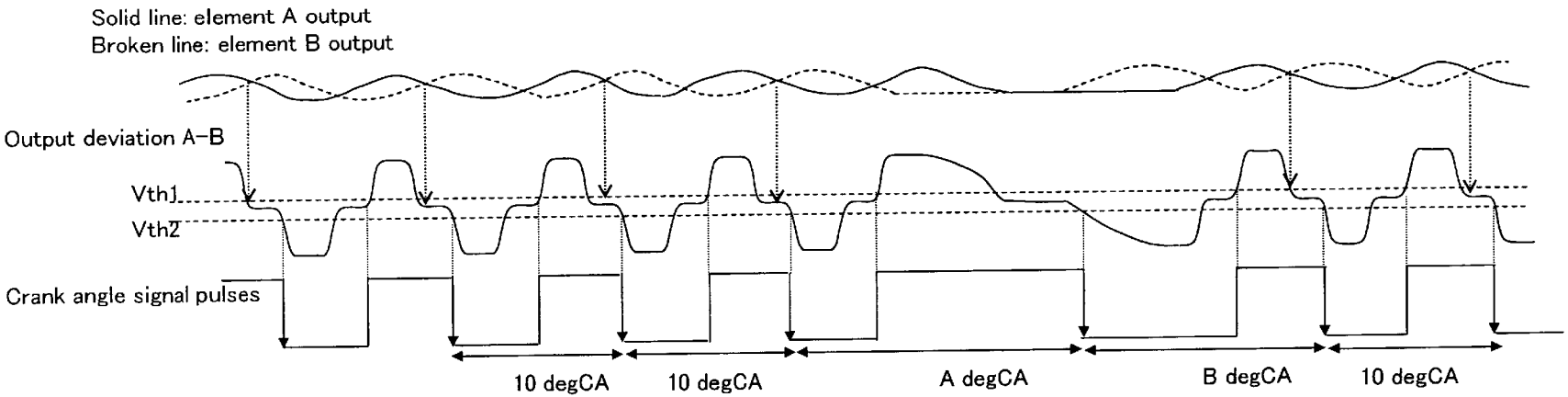
FIG. 10 shows a crank angle signal generated by the crank angle sensor of FIG. 8 when the crankshaft is rotating in the reverse direction.
Figure 11:
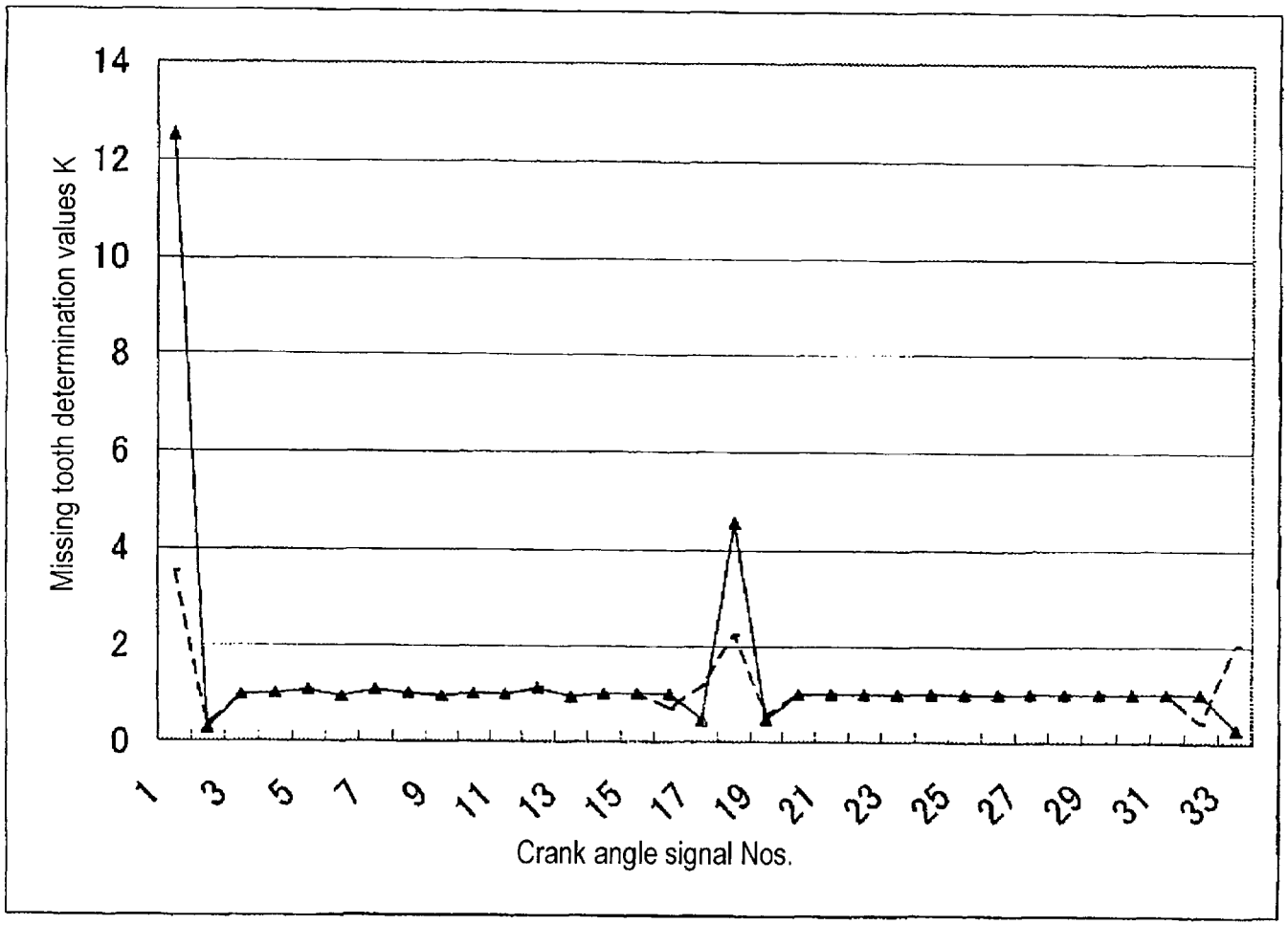
FIG. 11 shows missing tooth determination values of the crank angle detection apparatus according to the second embodiment of the present invention.
Figure 12:
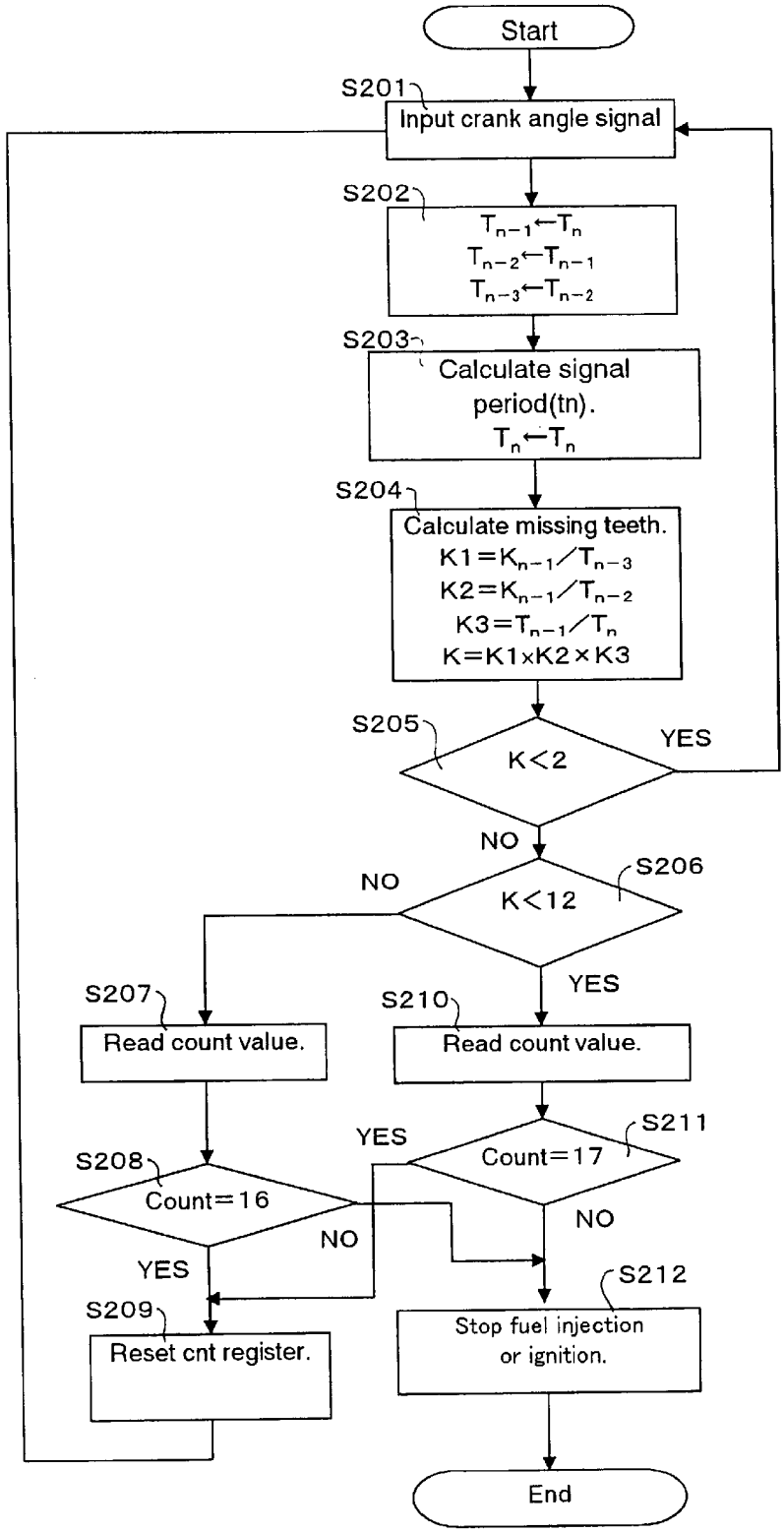
FIG. 12 is a flow chart showing the operation of the crank angle detection apparatus of FIG. 8.

FIG. 8 shows the configuration of a crank angle detection apparatus according to a second embodiment of the present invention. This second embodiment is different from the above-mentioned first embodiment in the construction and function of a crank angle sensor, but is similar in other respects to the first embodiment. FIG. 9 shows a crank angle signal generated when the crankshaft of FIG. 8 is rotating in the forward direction, and FIG. 10 shows a crank angle signal generated when the crankshaft of FIG. 8 is rotating in the reverse direction. FIG. 11 is a graph illustrating the periods of the crank angle signals and the missing tooth determination values in the crank angle detection apparatus of the second embodiment. FIG. 12 shows a flow chart for determining the rotational direction of the crankshaft by means of the crank angle detection apparatus of FIG. 8.

A crank angle sensor 13 is provided with an element A 14 and an element B 15 which are arranged adjacent to the measurement member 2 in a spaced apart relation with respect to each other in a circumferential direction thereof. These two element A 14 and element B 15 each generate one detection signal or pulse each time one of the angular position detection portions 3 of the measurement member 2 passes them. The crank angle sensor 13 generates a number of detection signal pulses corresponding to the number of angular position detection portions 3 of the measurement member 2 during the time the crankshaft 1 makes a complete revolution. Since the element A 14 and the element B 15 are arranged in a spaced apart relation from each other in a circumferential direction, as shown in FIG. 8, there exists a phase difference between the detection signals generated by the element A 14 and the element B 15, respectively, as shown in FIG. 9 and FIG. 10.

The detection signals generated from these element A 14 and element B 15 are input to a deviator or deviation part 16 where a difference or deviation between the detection signal of the element A 14 and the value of the detection signal of the element B 15 whose polarity is reversed is obtained, and a corresponding differential signal (A–B) representative of the difference thus obtained is output. The differential signal (A–B) output from the deviation part 16 is converted into a pulse-shaped crank angle signal by means of a determiner or determination part 17 that has two different determination threshold values. The two determination threshold values of the determination part 17 are Vth1 (V) and Vth2 (V), respectively, with Vth1 being set to be higher than Vth2. When the differential signal (A–B) crosses the determination threshold value Vth1 upwardly, the determination part 17 is triggered as the rising of a pulse of the crank angle signal, whereas when the differential signal (A–B) crosses the determination threshold value Vth2 downwardly, the determination part 17 is triggered as the falling of a pulse of the crank angle signal. Thus, each pulse generated by the determination part 17 is sent to the period detection part 6 and the counting part 8 as a crank angle signal, and thereafter the operation of this embodiment similar to that of the first embodiment is performed.

FIG. 9 shows the changing or transition of the crank angle signal during the forward rotation of the crankshaft, and FIG. 10 shows the changing or transition of the crank angle signal during the reverse rotation of the crankshaft. The periods between the falling timings of successive pulses of the crank angle signal are made signal periods, and input to the period detection part 6 and to the counting part 8 as well. A current signal period $T_n$ is detected or determined by the period detection part 6, and stored in the storage part 10. In the second embodiment, three successive periods comprising the last period $T_{n-1}$, the second last period $T_{n-2}$ and the third last period $T_{n-3}$ are stored in the storage part 10 as signal periods.

Then, a missing tooth determination value K is obtained by the reference position determination part 7 by using the signal periods $T_n$, $T_{n-1}$ and $T_{n-2}$. Here, $(K=(T_{n-1})^3/(T_{n-3}\times T_{n-2}\times T_n))$ is used as a missing tooth determination expression. Since the two element A 14 and elements B 15 are used to generate a pulse from a difference therebetween, the signal periods of pulses generated during the forward rotation of the crankshaft are different from those during the reverse rotation of the crankshaft, in consideration of which the missing tooth determination expression is accordingly set in an appropriate manner. In FIG. 11, the solid line represents missing tooth determination values K obtained from the data of three signal periods as in the case of the first embodiment, and the broken line represents missing tooth determination values K obtained by using the data of four signal periods. The accuracy in the detection of missing teeth according to this embodiment is improved, as shown in FIG. 11.

Subsequently, the first reference position and the second reference position are determined based on the missing tooth determination value K. At this time, determinations are made as follows: that is, when K is less than 2, there is no missing tooth; when K is equal to or greater than 2 but less than 12, the number of missing teeth is one; and when K is equal to or greater than 12, the number of missing teeth is two. Thus, the position of a pulse of the crank angle signal where two missing teeth have been detected is determined as the first reference position, and the position of a pulse of the crank angle signal where one missing tooth has been detected is determined as the second reference position. These information are sent to the counting part 8 and the rotational direction determination part 9, so that the rotational direction of the crankshaft 1 is determined by the rotational direction determination part 9 based on the count value of the counting part 8, as in the case of the first embodiment.

Next, the operation of the second embodiment will be explained based on a flow chart shown in FIG. 12. First in step S201, a crank angle signal is input from the crank angle sensor 13 to the period detection part 6 and the counting part 8. In step S202, the signal periods $T_{n-1}$, $T_{n-2}$ and $T_{n-3}$ are updated by signal periods $T_n$, $T_{n-1}$ and $T_{n-2}$, respectively, stored in the storage part 10. In step S203, the current signal period $T_n$ is obtained from the current input crank angle signal, and "1" is added to the count value of the counting register 11 of the counting part 8. In step S204, K1, K2 and K3 are calculated by using the following expressions: that is, $K1=T_{n-1}/T_{N-3}$; $K2=1/T_n/T_{n-2}$; and $K3=T_{n-}/T_n$. In addition, a missing tooth determination value K is calculated by using the following expression: that is, K=K1−K2=K3. In step S205, it is determined whether the missing tooth determination value K is less than 2. When it is less than 2, the control flow returns to step S201, whereas when the missing tooth determination value K is equal to or greater than 2, the control flow advances to step S206. In step S206, it is determined whether the missing tooth determination value K is less than 12. When it is equal to or greater than 12, the control flow advances to step S207, whereas when it is less than 12, the control flow advances to step S210. In step S207, a count value of the counting register 11 of the counting part 8 is read and then the control flow advances to step S208. In step S208, it is determined whether the count value is equal to 16. If it is equal to 16, the control flow advances to step S209, whereas if it is different from 16, the control flow advances to step S212. In step S209, the counting register 11 of the counting part 8 is reset and then the control flow returns to step S201. In step S210, a count value of the counting register 11 of the counting part 8 is read and the control flow advances to step S211. In step S211, it is determined whether the count value thus read is equal to 17. If the count value is equal to 17, the control flow advances to step S209, whereas if the count value is different from 17 or not equal to 17, the control flow advances to step S212. In step S212, a signal is sent to the electronic controller 12 which thereby stops either one of the fuel injection and the ignition of the internal combustion engine, thus completing or ending the operational process of the crank angle detection apparatus.

By using a sensor comprising the crank angle sensor 13 and the measurement member 2, the crank angle detection apparatus of this embodiment can determine the rotational direction of the crankshaft 1.

In addition, even if the crankshaft 1 is started to rotate from any crank angle position, it is possible to obtain the rotational direction of the crankshaft 1.

Moreover, sensitivity in detecting missing teeth can be improved by using the outputs of the two elements A 14 and elements B 15 with a phase difference therebetween.

Embodiment 3

Figure 13:
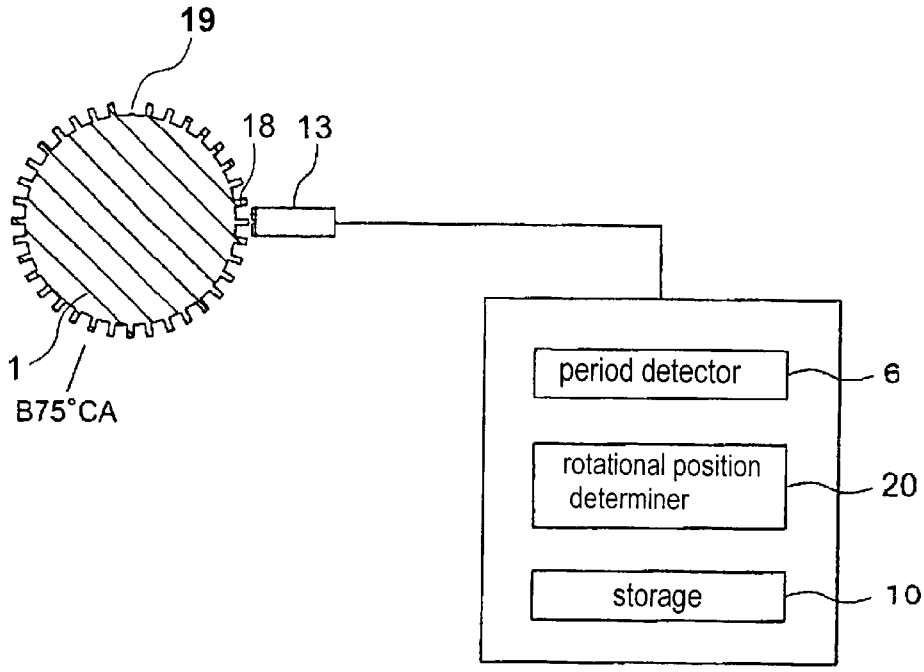
FIG. 13 is a schematic view of a crank angle detection apparatus according to a third embodiment of the present invention.
Figure 14:
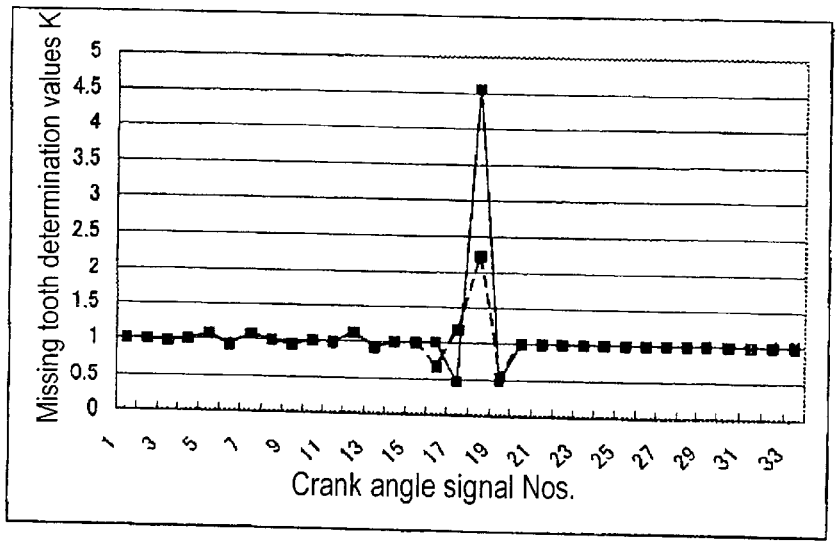
FIG. 14 shows missing tooth determination value according to the crank angle detection apparatus of FIG. 13.
Figure 15:
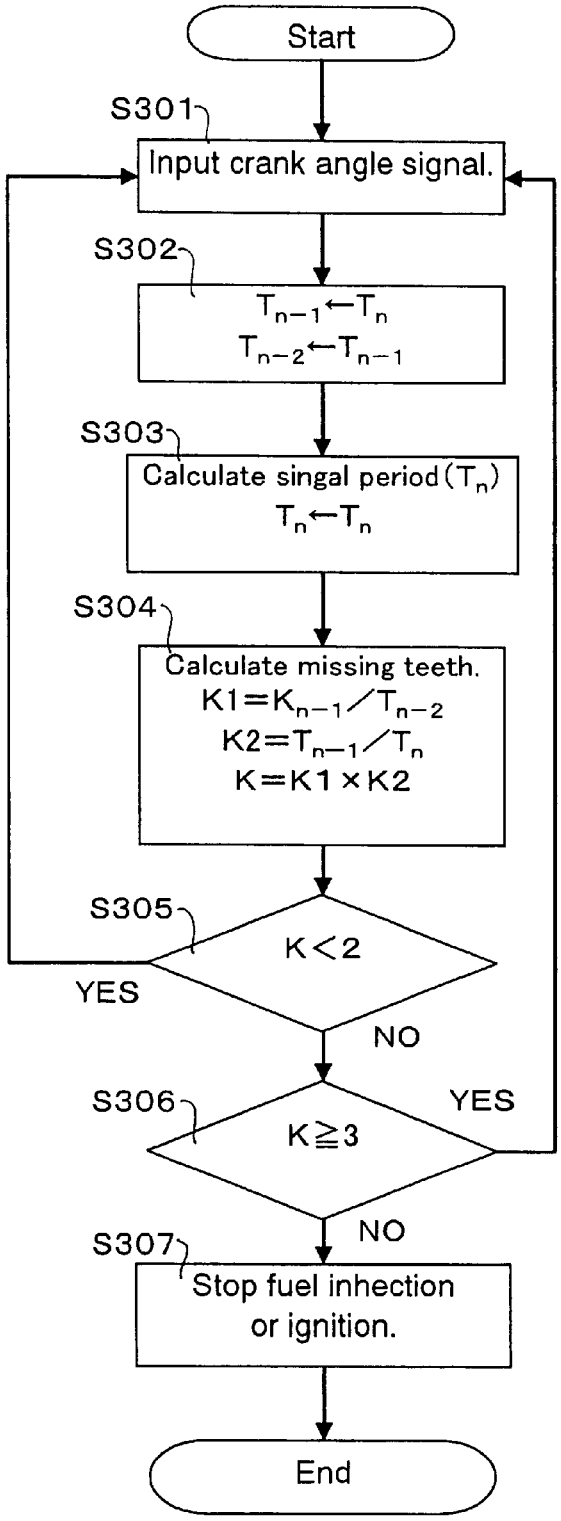
FIG. 15 is a flow chart showing the operation of the crank angle detection apparatus of FIG. 13.

FIG. 13 shows the configuration of a crank angle detection apparatus according to a third embodiment of the present invention. FIG. 14 shows missing tooth determination values of the crank angle detection apparatus of FIG. 13. FIG. 15 shows a flow chart of the operational process of the crank angle detection apparatus according to the third embodiment. In the third embodiment, a same crank angle sensor 13 as that of the above-mentioned second embodiment is used, and a measurement member 18 has a single reference position detection portion 19 alone. In addition, the crank angle detection apparatus includes a period detector or period detection part 6, a reference position determination part 7 and a rotational direction determination part 20.

When the reference position detection portion 19 passes the crank angle sensor 13 during the forward or reverse rotation of the crankshaft 1, the crank angle sensor 13 generates a crank angle signal as shown in FIG. 9 or a crank angle signal as shown in FIG. 10, respectively. A signal period $T_n$ is obtained from the crank angle signal by means of the period detection part 6. Then, a missing tooth determination value K at a reference position is calculated by using preceding signal periods $T_{n-1}$, $T_{n-2}$ and $T_{n-3}$ previously acquired by the reference position determination part 7 and a signal period $T_n$ currently obtained by the period detection part 4. As shown in FIG. 14, the solid line represents missing tooth determination values K during the forward rotation of the crankshaft, and the broken line represents missing tooth determination values during the reverse rotation of the crankshaft. The rotational direction determination part 20 determines the rotational direction of the crankshaft by using a missing tooth determination value K thus calculated. As shown in FIG. 14, a missing tooth determination value K at the reference position indicates 4.5 during the forward rotation of the crankshaft, and 2.2 during the reverse rotation of the crankshaft. The rotational direction determination part 20 determines whether the missing tooth determination value K at the reference position is less than 3 or equal to 3 or greater than 3, as a result of which it further makes a determination as to whether the crankshaft is rotating in the forward direction or in the reverse direction. When it is determined that the crankshaft is rotating in the reverse direction, an instruction or signal for stopping the fuel injection or ignition is given to the electronic controller 12 of the internal combustion engine.

Next, the operation of the crank angle detection apparatus of FIG. 13 will be explained by using the flow chart shown in FIG. 15. First in step S301, a crank angle signal is input from the crank angle sensor 13 to the period detection part 6, and in step S302, the signal periods $T_{n-2}$ and $T_{n-1}$ stored in the storage part 10 are updated by signal periods $T_{n-1}$ and $T_n$, respectively. In step S303, a current signal period $T_n$ is obtained from the crank angle signal input to the period detection part 6. In step S304, K1 and K2 are calculated by using expressions ($K1=T_{n-1}/T_{n-2}$) and ($K2=T_{n-}/T_n$), and additionally, a missing tooth determination value K is obtained by using an expression ($K=K1\times K2$). In step S305, it is determined whether the missing tooth determination value K is less than 2. When it is less than 2, the control flow returns to step S301, whereas when the missing tooth determination value K is equal to or greater than 2, the control flow advances to step S306. In step S306, it is determined whether the missing tooth determination value K is less than 3. When it is equal to or greater than 3, the control flow returns to step S301, whereas when it is less than 3, the control flow advances to step S307. In step S307, a signal is sent to the electronic controller 12 of the internal combustion engine, whereby either one of the fuel injection and the ignition of the internal combustion engine is stopped, thus completing or ending the operational process of the crank angle detection apparatus.

Thus, by using two elements arranged in a spaced apart relation from each other in a circumferential direction to obtain a difference between the detection outputs of these elements which are different in phase from each other, it is possible to determine the rotational direction of the crankshaft just by determining signal periods and a missing tooth.

The period detection part 6, the reference position determination part 7 and the rotational direction determination part 20 of this crank angle detection apparatus can be constituted by a microcomputer, and hence the crank angle detection apparatus can be achieved by the use of a small-sized microcomputer.

Embodiment 4

Figure 16:
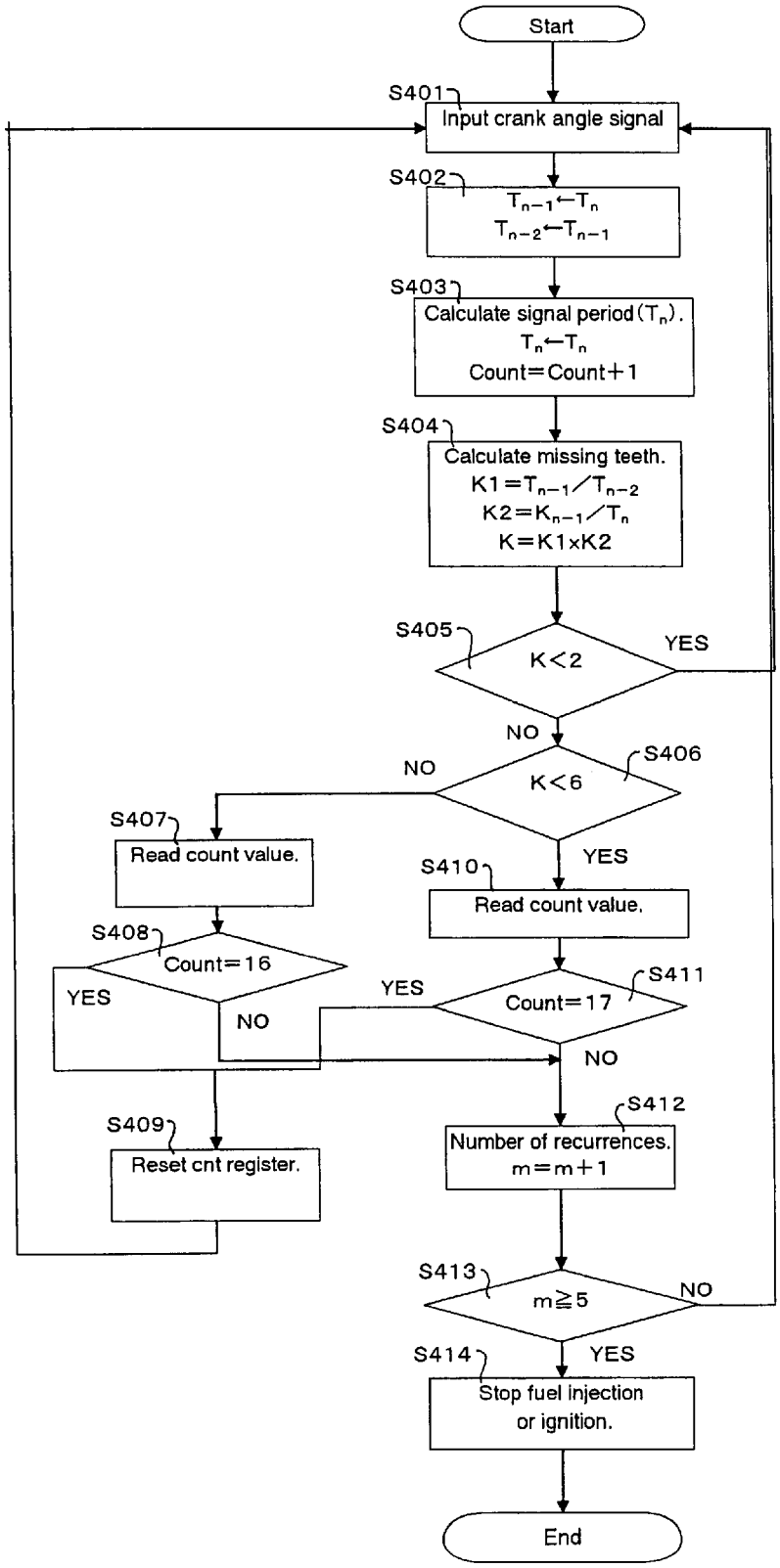
FIG. 16 is a flow chart showing the operation of a crank angle detection apparatus according to a fourth embodiment of the present invention.

FIG. 16 is a flow chart that shows the operation of a crank angle detection apparatus according to a fourth embodiment of the present invention. This fourth embodiment is different from the first embodiment in the function of a rotational direction determination part 9 alone, but is similar in other respects to the first embodiment, thus omitting a description of the similar parts or portions.

Now, the operation of the crank angle detection apparatus according to this fourth embodiment will be explained based on FIG. 16. Steps from S401 to S411 are the same as the steps from S201 to S211 in the first embodiment. In steps S408 and S411, when the count value of the counting register 11 of the counting part 8 is different from a predetermined value, it is determined that the crankshaft 1 is rotating in the reverse direction, and the control flow advances to step S412. In step S412, the number of recurrences m, which represents the number of times of missing tooth determinations, is incremented by "1", and the control flow advances to step S413 where it is determined whether the number of recurrences m is equal to or greater than 5. When it is less than 5, the control flow returns to step S401 whereas when the count value is equal to or greater than 5, the control flow advances to step S414. In step S414, an instruction or signal for stopping the fuel injection or ignition is sent to the electronic controller 12 of the internal combustion engine, and the operation of the crank angle detection apparatus is ended.

In the crank angle detection apparatus according to the fourth embodiment, even in case where a determination of the presence of missing teeth is made under the influence of noise or the like on the crank angle signal, it is possible to determine that the crankshaft is rotating in the reverse direction, when the presence of missing teeth has recurred a predetermined number of times. Consequently, the reliability of the apparatus can be improved.

Embodiment 5

Figure 17:
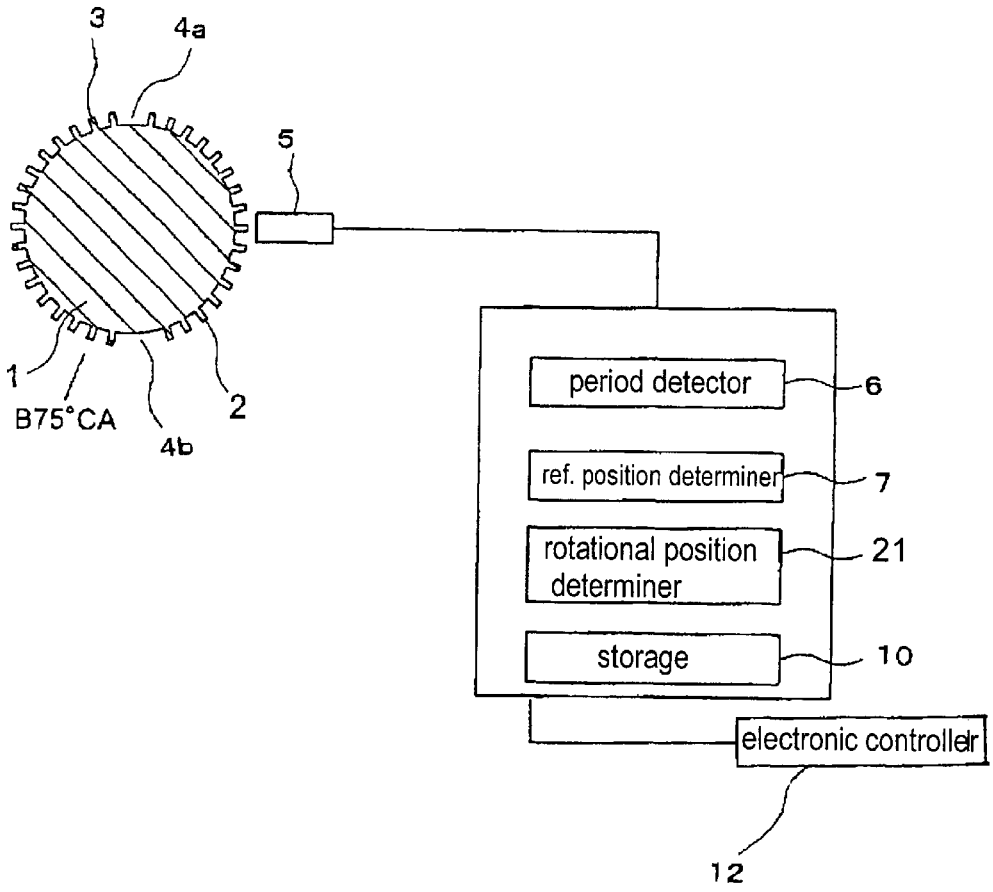
FIG. 17 is a schematic view of a crank angle detection apparatus according to a fifth embodiment of the present invention.
Figure 18:
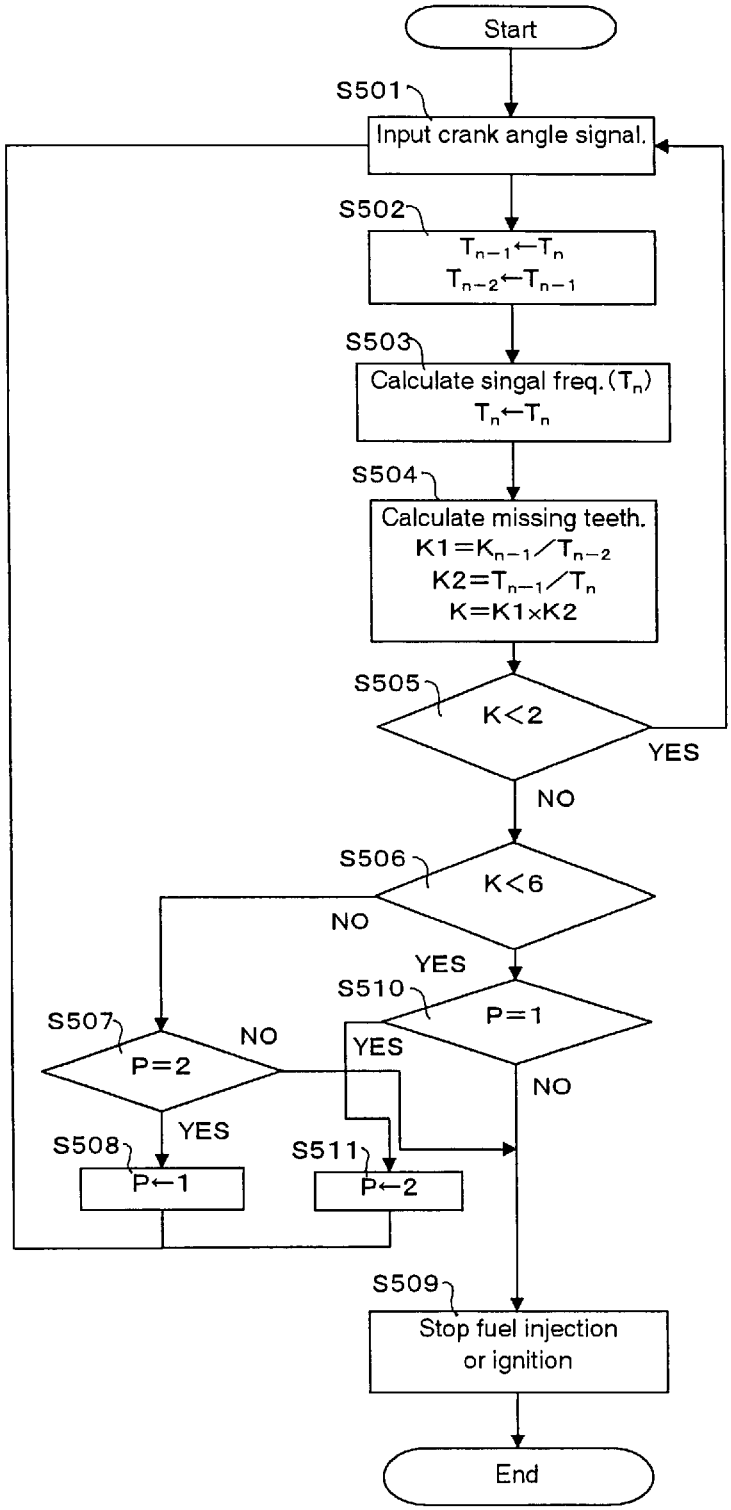
FIG. 18 is a flow chart showing the operation of the crank angle detection apparatus of FIG. 17.

FIG. 17 shows the configuration of a crank angle detection apparatus according to a fifth embodiment of the present invention. FIG. 18 is a flow chart that shows the operation of the crank angle detection apparatus of FIG. 17. This fifth embodiment is different from the above-mentioned first embodiment in the operation or function of a rotational direction determination part 21 and in the non-provision of a counting part. Hereinafter, the rotational direction determination part 21 will be described while referring to FIG. 18. Steps from S501 to S506 are the same as the steps from S101 to S106 in FIG. 3, but in S503, an incrementation of the count value is not carried out. When it is determined in step S506 that a missing tooth determination value K is equal to or greater than 6, the control flow advances to step S507 where a determination is made as to whether a missing tooth value p is equal to 2. When the missing tooth value p is equal to 2, it is determined that the crankshaft rotates in the forward direction. Then in step S508, the missing tooth value p is rewritten into "1" and the control flow returns to step S501. On the other hand, when the missing tooth value p is not equal to 2, the control flow advances to step S509. When it is determined in step S506 that the missing tooth determination value K is equal to or greater than 2 but less than 6, the control flow advances to step S510 where a determination is made as to whether the missing tooth value p is equal to 1. When the missing tooth value p is equal to 1, it is determined that the crankshaft is rotating in the forward direction. Then in step S511, the missing tooth value p is rewritten into "2", and the control flow returns to step S501. When the missing tooth value p is not equal to 1, the control flow advances to step S509 where an instruction or signal for stopping the fuel injection or ignition is sent to the electronic controller 12 of the internal combustion engine, and the operation of the crank angle detection apparatus is ended.

Thus, even if the crankshaft is caused to rotate only one revolution in the reverse direction, it is possible to accurately determine the reverse rotation of the crankshaft. Therefore, the reverse rotation of the internal combustion engine can be positively prevented from continuing, and damage to the internal combustion engine can be suppressed to a minimum.

Since the period detection part 6, the reference position determination part 7 and the rotational direction determination part 21 of this crank angle detection apparatus can be constituted by a microcomputer, it is possible to achieve the crank angle detection apparatus with a small-sized microcomputer.

As can be seen from the foregoing description, the present invention provides the following excellent advantage.

According to the present invention, there is provided a crank angle detection apparatus including: a measurement member mounted on a crankshaft of an internal combustion engine or a portion that rotates in synchronization with the crankshaft, the measurement member having a plurality of angular position detection portions arranged at equal intervals in a circumferential direction of the crankshaft and a plurality of reference position detection portions at which a part of the angular position detection portions is missing; a crank angle sensor arranged at a location adjacent to the measurement member for generating a crank angle signal in the form of a train of pulses corresponding to the angular position detection portions and the reference position detection portions; a period detection part for detecting signal periods of successive pulses of the crank angle signal; a reference position determination part for determining a plurality of reference positions based on the signal periods detected by the period detection part; a counting part for counting the pulses of the crank angle signal to provide a count value thereof; and a rotational direction determination part for determining the rotational direction of the crankshaft based on the number of pulses of the crank angle signal counted between the plurality of reference positions. With this arrangement, it is possible to obtain the crank angle signal by means of the single crank angle sensor alone without using a plurality of sensors, and at the same time it is also possible to determine or identify the rotational direction of the crankshaft, thus making it possible to stop the operation of the internal combustion engine if the engine is rotating in the reverse direction.

Moreover, even if the internal combustion engine is started from any crank angle position, the reverse rotation thereof can be detected in a reliable manner by means of the rotational direction determination part that detects the reverse rotation of the measurement member based on the result of reference position determination according to the interval or duration of missing pulses of the crank angle signal.

While the invention has been described in terms of preferred embodiments, those skilled in the art will recognize that the invention can be practiced with modifications within the spirit and scope of the appended claims.

What is claimed is:

1. A crank angle detection apparatus comprising:

a measurement member mounted on a crankshaft of an internal combustion engine or a portion that rotates in synchronization with said crankshaft, said measurement member having a plurality of angular position detection portions arranged at equal intervals in a circumferential direction of said crankshaft and a plurality of reference position detection portions at which a part of said angular position detection portions is missing;

a crank angle sensor arranged at a location adjacent to said measurement member for generating a crank angle signal in the form of a train of pulses corresponding to said angular position detection portions and said reference position detection portions;

a period detection part for detecting signal periods of successive pulses of said crank angle signal;

a reference position determination part for determining a plurality of reference positions based on the signal periods detected by said period detection part;

a counting part for counting the pulses of said crank angle signal to provide a count value thereof; and a rotational direction determination part for determining the rotational direction of said crankshaft based on the number of pulses of said crank angle signal counted between said plurality of reference positions.

2. The crank angle detection apparatus as set forth in claim 1, wherein said reference position determination part determines said reference positions by comparing ratios between a current signal period obtained by said period detection part and a plurality of preceding signal periods previously obtained thereby in a time series manner with a prescribed reference value.

3. The crank angle detection apparatus as set forth in claim 1, wherein said rotational direction determination part determines the rotational direction of said crankshaft by utilizing the fact that said count value counted between two positions among said plurality of reference positions during the reverse rotation of said crankshaft is different from that during the forward rotation of said crankshaft.

4. The crank angle detection apparatus as set forth in claim 1, wherein said rotational direction determination part determines the rotational direction of said crankshaft by utilizing the fact that a signal period corresponding to one of said reference positions during the forward rotation of said crankshaft is different that during the reverse rotation of said crankshaft.

5. The crank angle detection apparatus as set forth in claim 1, wherein when said reference position determination part determines that successive ones of said reference positions are the same, said rotational direction determination part determines that said crankshaft is rotating in the reverse direction.

6. The crank angle detection apparatus as set forth in claim 1, wherein said rotational direction determination part determines that said crankshaft is rotating in the reverse direction when said crankshaft continues to rotate in the reverse direction for a plurality of strokes of said internal combustion engine.

7. The crank angle detection apparatus as set forth in claim 1, wherein said crank angle sensor includes a plurality of elements for generating signals of different phases, a deviation part for obtaining a deviation between said signals, and a determination part for converting said deviation into a crank angle signal.

8. The crank angle detection apparatus as set forth in claim 7, wherein said determination part converts said deviation by using different threshold values to provide said crank angle signal.

9. The crank angle detection apparatus as set forth in claim 1, wherein when it is determined that said crankshaft is rotating in the reverse direction, a signal is generated for stopping fuel injection or ignition of said internal combustion engine.

* * * * *